US005301872A

United States Patent [19]

Tusing et al.

[11] Patent Number: 5,301,872

[45] Date of Patent: Apr. 12, 1994

[54] COLLAPSIBLE PALLET CONTAINER APPARATUS

[75] Inventors: Michael A. Tusing, Canton; Robert B. Leftwich, Taylor, both of Mich.

[73] Assignee: Stone Container Corporation, Chicago, Ill.

[21] Appl. No.: 899,773

[22] Filed: Jun. 17, 1992

[51] Int. Cl.[5] ..... B65D 5/36

[52] U.S. Cl. ..... 229/117.03; 206/600; 229/117.05

[58] Field of Search ..... 206/600; 229/23 R, 117.03, 229/117.05, 117.06

[56] References Cited

U.S. PATENT DOCUMENTS

| | | | |
|---|---|---|---|
| 3,119,547 | 1/1964 | Nute | 229/117.06 |
| 3,199,762 | 8/1965 | Coons | 229/117.06 |
| 3,642,192 | 2/1972 | Wilcox, Jr. et al. | 229/117.05 |
| 3,770,186 | 11/1973 | Kupersmit | 229/23 R |
| 4,100,859 | 7/1978 | Clark, Jr. | 206/600 |
| 4,373,637 | 2/1983 | Shippell | 206/600 |
| 4,545,482 | 10/1985 | Novatny | 206/320 |
| 4,606,461 | 8/1986 | Bolton, Sr. | 206/600 |
| 4,691,859 | 9/1987 | Snyder | 229/23 R |
| 4,712,687 | 12/1987 | Silcott et al. | 206/600 |
| 4,793,507 | 12/1988 | Delplanque | 217/13 |
| 4,863,024 | 9/1989 | Booth | 206/600 |
| 4,880,141 | 11/1989 | Gossler et al. | 220/464 |
| 4,949,898 | 8/1990 | Nederveld | 229/117.02 |
| 4,969,559 | 11/1990 | Nederveld | 206/600 |
| 5,071,010 | 12/1991 | Carufel/Zeman | 206/600 |
| 5,163,555 | 11/1992 | West et al. | 206/600 |

*Primary Examiner*—Gary E. Elkins
*Attorney, Agent, or Firm*—Dick and Harris

[57] ABSTRACT

A collapsible pallet container apparatus for the containment of various articles including bulk materials. A container portion attached to a pallet includes automatic collapse prompting and deployment features for facilitating the collapse and deployment of the container thereby minimizing the labor effort and number of operations required for each operation. The container further contains a lower periphery that is completely and automatically sealed when in the deployed position so as to prevent migration of articles or materials from within the container to the surrounding environment.

21 Claims, 3 Drawing Sheets

Fig 9
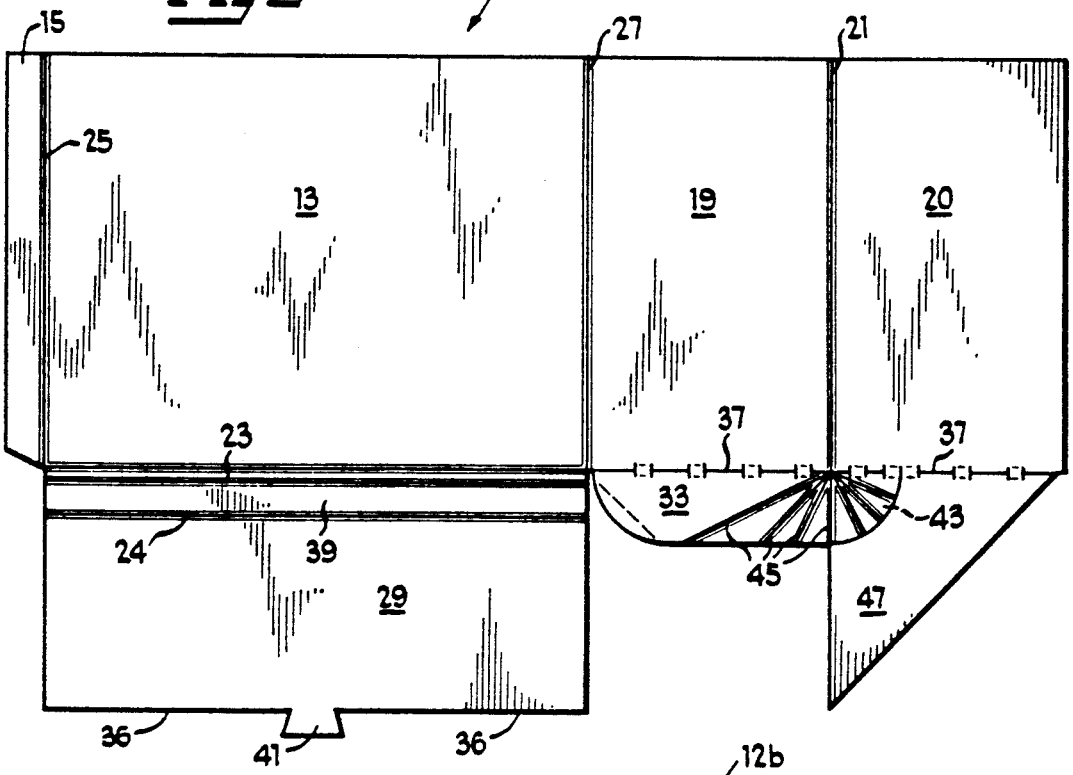
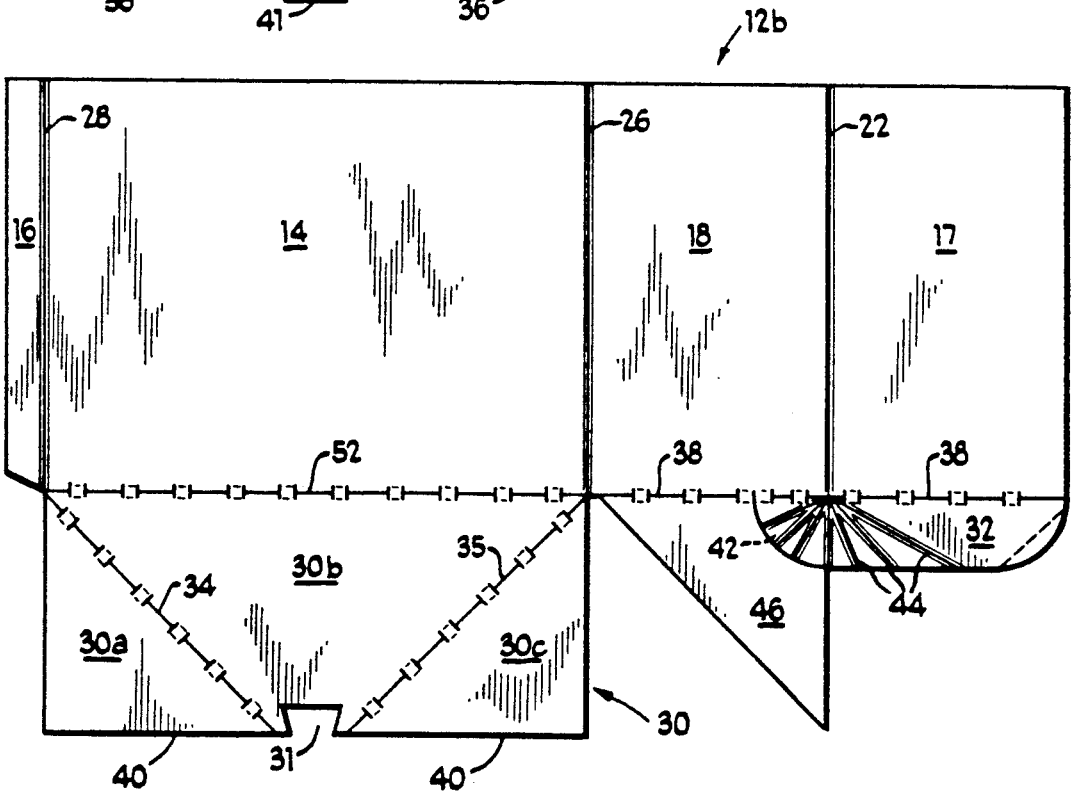
Fig 10

COLLAPSIBLE PALLET CONTAINER APPARATUS

BACKGROUND OF THE INVENTION

The present invention relates in general to a container apparatus and in particular to a collapsible container apparatus attached to a pallet so as to substantially facilitate the collapse of the container to a minimized profile when storage of the apparatus is required while alternatively providing a selfprompting sealed container area to prevent the migration of materials from within the apparatus to the outside environment when the apparatus is fully deployed.

Pallets have been used for many years by shippers and transporters of various materials. These pallets typically provide a flat and sturdy surface on which materials can be placed and stacked. In order to assure that the materials remain on the pallet, various sized and shaped containers have been attached to the tops of pallets so as to present a bounded area in which to place and/or remove the materials being shipped or stored.

Containers that have been conventionally attached to pallets range from nothing more than four walls and a bottom which utilize the pallet top surface as a support, to more intricate collapsible pallet-container combinations. Most early pallet-container combinations were not collapsible and retained their shape, configuration and dimensions whether in use or not, thereby requiring excess space when stored between uses.

Other configurations of pallet-container combinations allowed for the pallet and container to be formed out of different structural materials, the extra material required, the extra space required when not in use and the extra costs associated therewith were often prohibitive.

In most prior art pallet-container combinations, the larger the combination is, the less manageable it often becomes. Many such combinations require extensive time and effort to fully deploy the container portion of the combination. There is often a necessity to hold down one portion of the container while attempting to deploy another portion. This arrangement very often necessitates more than one individual to articulate and deploy the container, or conversely to collapse the combination after use.

Further, in such prior art constructions, where the container is attached to the pallet along a lower edge periphery, there often exists gaps between the lower edges of the container and the top surface of the pallet which would allow for the contents within the container to migrate out between the pallet and the lower edges of the container. In an effort to overcome this undesirable problem, additional flaps must be manually and repetitively deployed to seal the edges requiring further effort, labor costs and time.

The prior art pallet-container combinations include U.S. Pat. No. 4,373,637 to Shippell which discloses a pallet-container combination wherein the container portion requires substantial effort to deploy and collapse. To configure the container portion into the deployed position, for example, bottom flaps 56 and 58 must in Shippell be manually repositioned from their non-deployed position. Similarly, upon reconfiguration of the container from the deployed position to the collapsed position, the bottom flaps 56 and 58 must again be manually repositioned.

Additional prior art pallet-container combinations include U.S. Pat. No. 5,071,010 to Carufel/Zeman; U.S. Pat. No. 4,969,559 to Nederveld: U.S. Pat. No. 4,949,898 to Nederveld; U.S. Pat. No. 4,793,507 to Delplanque; U.S. Pat. No. 4,880,141 to Gossler, et al.; U.S. Pat. No. 4,712,687 to Silcott, et al.; U.S. Pat. No. 4,606,461 to Bolton Sr.; and U.S. Pat. No. 4,545,482 to Novatny. While this prior art relates in varying degrees to the present invention, they lack the many advantages of the present invention.

For example, while disclosing a collapsible container Carufel/Zeman '010, Delplanque '507 and Bolton Sr. '461 additionally disclose the need for further support members inserted into the container portion to provide support and rigidity to the container, Similarly, silcott '687, gossler '141 and Nederveld '559 lack automatic deployment and collapse prompting features while requiring considerable effort to assemble. Nederveld '898 provides for embodiments lacking the sealing of portions of the lower periphery of the container.

It is thus an object of the present invention to create an inexpensive, easy to assemble pallet-container apparatus that can be utilized with a variety of pallets formed into a variety of sizes and out of a variety of materials.

It is a further object of the invention to provide a container portion that requires a minimized amount of time and effort, by one individual, to deploy and collapse with a few operational steps. In so doing, it is an object to achieve automatic prompting towards articulated transition of many of the container's panels and flaps.

An additional object of the invention, is to provide a container portion that has an automatically sealed lower periphery to prevent inadvertent or accidental migration of the contents within the container to the outside environment.

Similarly it is an object to minimize the amount of materials utilized to form the container portion and to minimize the overall profile of the container-pallet combination when not in use and fully collapsed.

These and other objects of the invention will become apparent in light of the present specification and drawings.

SUMMARY OF THE INVENTION

The present invention comprises a collapsible pallet container apparatus for automatically prompting the collapse and deployment of the apparatus so that upon full articulated deployment articles may be positioned within the interior region of the container while on full collapse the overall profile of the apparatus is minimized.

In a preferred embodiment of the invention, the apparatus comprises a pallet and a container attached to the top surface of the pallet. The container comprises front panel members, back panel members and one or more side panel members that are positioned between the front and back panel members. The front, back, and one or more side panels members each respectively have an upper and lower edge, as well as respective side edges, which are attached to one another so as to form a contiguous periphery of the container. At least one of the one or more side panels contains an articulation means to allow the side panel, and in turn the container, to fold inwardly towards the interior region of the container upon reconfiguration of the apparatus from an articulated deployed position to a fully collapsed position.

In this preferred embodiment, the container further comprises a bottom panel which includes front, back and one or more side edges and which covers and is restrainably attached to at least a portion of the top surface of the pallet. The bottom panel attaches the container to the pallet by not only being attached to a portion of the pallet but by also being hingedly emanating from at least one of the front, back and side panels at the respective front, back and side edges of the bottom panel.

To facilitate the deployment and collapse of the apparatus, collapse prompting members are associated with at least one of the bottom and one or more side panel articulation members so as to provide for a biasing of the apparatus from the deployed position to the collapsed position upon the movement or jarring of at least one of the front, back and one or more side panel members.

The apparatus in this preferred embodiment also includes automatically deployable and collapsible sealing flaps emanating and hingedly attached to at least one of the one or more side panel members at seal flap folds. Each of the sealing flaps is positionable so that upon deployment of the container the sealing flaps move from their stored location adjacent to the respective one or more side panel members to a position juxtaposed and on top of the bottom panel. Similarly, each of the sealing flaps is capable of automatically moving positions from juxtaposed and on top of said bottom panel when in the fully deployed position to their respective storage location adjacent to a side panel member. In addition to facilitating deployment and collapse of the container, the sealing flaps permit the apparatus to collapse to an overall profile that is now minimized. Furthermore, seal flap folds, which attach the sealing flaps to the one or more side panel members, prevent the migration of articles from within the interior region of the container to the outside environment.

Also emanating from a portion of the lower edges of the one or more side panel members are wing flaps. As with the sealing flaps, the wing flaps are capable of automatic deployment from a position adjacent to the respective one or more side panel members, when in the stored position, to a position juxtaposed and on top of a portion of the bottom panel when the container is articulated to full deployment. Each of the wing flaps is restrainably attached to a portion of the bottom panel as well as hingedly attached to at least a portion of the lower edge of respective one or more side panel members. The hinge between the wing flaps and respective one or more side panel members is utilized to further prevent migration of articles from the interior region of the container to the outside environment. Upon full deployment of the container, the lower periphery of the container as defined by the lower edges of the back panel member, the front panel member, the bottom panel and the one or more side panel members is completely sealed and enclosed to prevent and preclude migration of articles between the top surface of the pallet and the respective lower edges of the front panel, back panel and one or more side panel members.

Preferably, the apparatus further comprises a single front panel, a single back panel, positioned across from the front panel and two side panels located opposite each other and between the front and back panels. Each of the side panels contains a panel articulation fold that traverses the side panels from their respective lower edges to their respective upper edges and which bisects the side panels so that the distance between respective side edges and the articulation fold is approximately equal to each other, thereby dividing the respective side panels in half. Furthermore, when the collapsed prompting members are activated, the articulation folds move inwardly towards each other and the interior region of the container thereby drawing the front and back panels inwardly towards each other—to reduce the distance between the two panels and, in turn, reduce the overall collapsed profile of the container and apparatus.

In this preferred embodiment, the sealing flaps comprise two sealing flaps, one of each being positioned on each of the respective opposite side panels and transversing a distance from the lower edge of the back panel towards the front panel to a location beyond the articulation fold within the respective side panel. Each of the respective sealing flaps further contains a starburst score pattern proximate to the articulation folds in the respective side panels so that upon collapse of the container the sealing flaps are adjacent to and wrapped around the respective articulation folds and in turn the respective side panels. Also hingedly attached to the respective side panels is the wing flap which, in this embodiment, includes a recessed area to be utilized for receipt of a portion of the adjacent sealing flap. Upon full deployment, the respective adjacent sealing flap and wing flap become substantially co-planar to each other so as to be juxtaposed to the bottom panel.

The bottom panel of the preferred embodiment comprises a collapse flap, a pallet attachment flap, a transition flap member and bottom panel flap alignment members wherein the collapsed flap, pallet attachment flap and transition flap member cooperate with each other as well as with the remainder of the container so as to facilitate the transition of the apparatus from a fully articulated and deployed configuration to a fully collapsed position wherein the overall profile of the apparatus is minimized. The bottom panel flap alignment member further comprises a male tab positioned on the front edge of the pallet attachment flap and a female slot operably positioned in the transition flap member, so that upon deployment of the container the male tab will engage the female slot—to effectively align, lock and stabilize the container by securing the relative position of the collapse flap, pallet attachment flap and transition flap member. The locking of the male tab and female slot may further be enhanced by an interference friction fit created between the male tab and female slot or alternatively, by a positive non-retractable interface upon insertion of the male tab into the female slot.

In the preferred embodiment, the lower periphery of the container is configured so that the collapse flap, pallet attachment flap and transition flap members are utilized to effectively seal any gaps that may exist along a portion of the lower periphery of the container so as to prevent migration of articles from the interior region of the container to the outside environment. The collapse flap is position between the lower edge of the back panel and the pallet attachment flap and has a height that corresponds to the overall thickness of the container when in the fully collapsed orientation; so as to permit the container to be folded over, positioned upon and hingedly attached to the top surface of the pallet. In addition, the pallet attachment flap, hingedly emanating from the collapse flap at pallet attachment flap fold, is secured to a portion of the top surface of the pallet. The pallet attachment flap fold is positioned at the back edge of the pallet attachment flap which is opposite to the front edge and spans the distance between the two respective side edges. The front edge of the pallet attachment flap is positioned at and between the articulation folds in the respective one or more side panels when the container is in the fully articulated deployed configuration.

The transition flap members of this preferred embodiment further contains a front edge, a back edge and two side edges positioned between the front and back edges wherein the front edge of the transition flap members and the lower edge of the front panel members are hingedly attached by transition flap folds. The back edge of the transition flap members is positioned so as to extend at and between the panel articulation folds in the respective one or more side panels when the container is in the fully articulated deployed position.

The transition flap members further comprise a transition flap center panel and two transition flap side panels hingedly attached to each opposite side edge of the transition flap center panel by transition panel folds. The respective wing flaps which hingedly emanate from respective side panel members are attached to the two respective transition flap side panels. Such attachment facilitates the sealing of the lower periphery of the container by preventing migration of articles through any gaps that may have existed between the transition flap side panels and the respective side panel members. The transition flap folds, wing flap folds and respective panel folds are hinged through a type of specific scored and crushed alternating fold. Such alternating scoring and crushing biases the respective wing flaps, front panel members, side panel members, transition flap center panel and transition flap side panels to a position of either 0 or 90 degree orientation to respective adjacent wing flap, front panel member, side panel members, transition flap center panel and transition flap side panel so as to create a bias in the overall container towards at least a preliminarily collapsed position. Such biasing can be utilized to prompt collapse by, for example, elevating, jarring, or otherwise simply reorientating at least one of the front, back and side panel members when the container is in its fully articulated and deployed position, while simultaneously disengaging the bottom panel flap alignment members.

In the preferred embodiment, the container further comprises closure flap members which hingedly emanate from the respective side edges of at least one of the front and back panels. The closure flaps comprise two closure flaps, each of which includes an upper edge, a lower edge and two side edges positioned opposite to each other and between the upper and lower edges. One of the closure flaps emanates from the side edge of the front panel while the second of the closure flaps emanates from a side edge of the back panel by closure flap folds. Additionally, each closure flap is restrainably attached to the adjoining side panel so as to integrate the front, back and side panels as well as the bottom panel into a single integrated container of contiguous material. Through such a construction, the single integrated contiguous container may be formed out of two blanks of container material. The first material blank comprises the back panel, the collapse flap, the pallet attachment flap, one of the side panels, one of the closure flaps, one of the wing flaps and one of the sealing flaps while the second material blank comprises the front panel, the transition flap means (with transition flap center and side panels), the second side panel means, the second closure flap, the second wing flap and the second sealing flap. When joined together, these two material blanks form a contiguous integrated container as described herein. These blanks and the apparatus may be formed out of many different types of material. While the pallet and the container need not be constructed from the same material, it is envisioned that the container portion be constructed out of a substantially biodegradable, paperboard material, preferably corrugated paperboard. Similarly, the pallet may be formed from a corrugated paperboard material or any other materials that may be appropriate for its function.

BRIEF DESCRIPTION OF THE DRAWINGS

FIG. 9 of the drawings is an elevated view of a portion of the non-articulated container blank, comprising a single unitary sheet of material containing a pallet attachment flap, collapse flap, first sealing flap means, back panel means, a first side panel means, a first wing flap means and a first closure flap; and FIG. 10 is an elevated view of the second portion of the non-articulated container blank, comprising the transition flap means, a second sealing flap means, front panel means, a second side panel means, a second wing flap means and a second closure flap means.

DETAILED DESCRIPTION OF THE DRAWINGS

Figure 1:
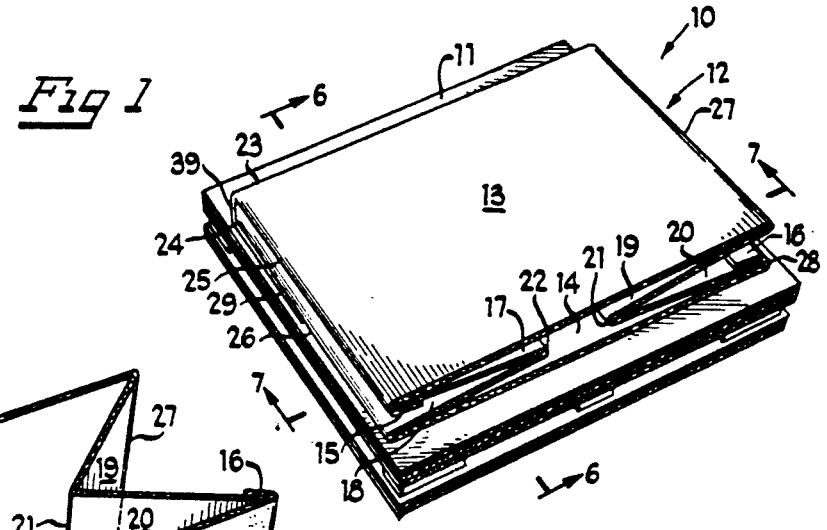
FIG. 1 of the drawings is a perspective view of the collapsible pallet container apparatus in its fully collapsed position, prior to deployment and articulation of the container portion into an article enclosure configuration.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Collapsible pallet container apparatus 10 is shown in FIG. 1 in the fully collapsed position in which the overall profile of the apparatus is minimized. Apparatus 10 comprises pallet means 11 and container means 12 which is attached thereto. Container means 12 comprises front panel means 14, back panel means 13, side panel means 17–18 and 19–20, and bottom panel means 29, 30 and 39. Container means 12 is restrainably attached to pallet means 11 at pallet attachment flap 29, which comprises a portion of bottom panel means 29, 30 and 39. Bottom panel means 29, 30 and 39 includes pallet attachment flap 29, transition flap means 30*a* through *c* and collapse flap 39, as fully shown in FIGS. 3, 5, 9 and 10.

In the fully collapsed position, container means 12 lies juxtapose to overlay pallet means 11 so as to minimize the area required for storage of apparatus 10. Container means 12 is collapsed with back panel means 13 and front panel means 14 substantially parallel to each other as well as parallel to pallet means 11. Side panel means 17–18 and 19–20 are positioned so as to lie between and adjacent to back and front panel means 13 and 14 and are sandwiched therebetween. Similarly, side panel means 17–18 and 19–20 are folded in such a way so that side panel means portions 17 and 19 overlie side panel means portions 18 and 20 respectively, thereby forming a "V" about articulation folds 22 and 21. Pallet attachment flap 29 is operably positioned between and juxtaposed to both front panel means 14 and pallet means 11. Likewise, collapse flap 39 is hingedly attached to lower edge 23 of back panel means 13 as well as to pallet attachment flap 29 at scored fold 24.

Figure 2:
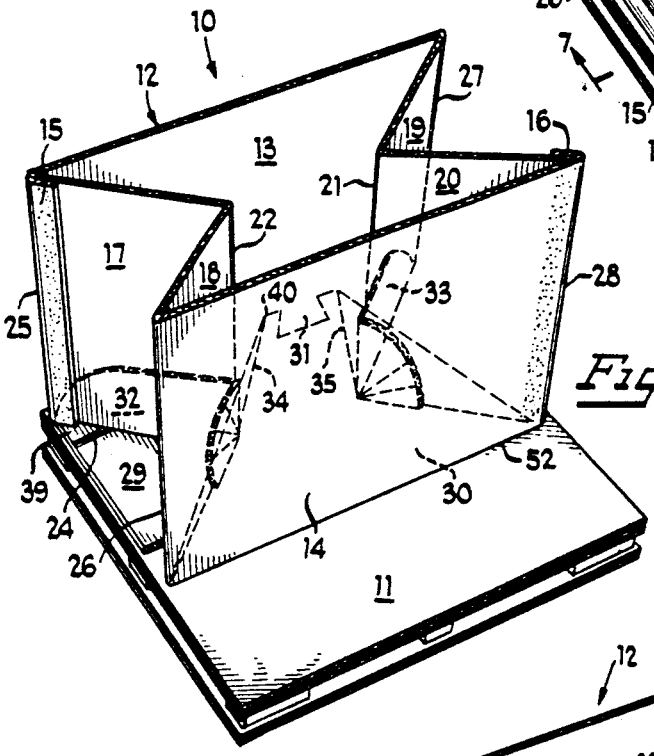
FIG. 2 is a perspective view of the container portion of the apparatus in its preliminarily collapsed position with transition flap means, and sealing flap means moving towards a position adjacent and juxtaposed to the top surface of the pallet means.

FIG. 2 shows apparatus 10 in a preliminarily collapsed position, where pallet attachment flap 29 of container means 12 remains juxtaposed to and restrainably attached to pallet means 11. Pallet attachment flap 29 is further attached to collapse flap 39 which is substantially co-planar to pallet attachment flap 29. Also attached to collapse flap 39 at back edge 23 is back panel means 13.

As can be seen in FIG. 2, container means 12 is only preliminarily collapsed so that front, back and side panel means 14, 13, 17–18 and 19–20, respectively, are substantially vertical as well as perpendicular to pallet means 11. Back panel means 13 is also hingedly attached to side panel means portion 19 which emanates from back panel means at side edge 27. At the opposite side edge 25, closure flap means 15 is also hingedly emanating from back panel 13 and overlies side panel means portion 17, thereby attaching side panel means 17–18 to back panel means 13. Front panel means 14 is similarly situated with respect to transition flap means 30 and side panel means portions 18 and 20. Side panel means portion 18 is hingedly emanating from side edge 26 of front panel means 14. At the opposite side edge 28, closure flap means 16 is hingedly emanating from front panel means 14 and overlies side panel means portion 20 thereby attaching front panel means 14 to side panel means 19–20. Articulation folds 22 and 21 are positioned within the respective side panel means 17–18 and 19–20 so as to traverse the distance between the upper and lower edges of side panel means 17–18 and 19–20, with side panel means 17–18 and 19–20 being of substantially the same size. Upon deployment, articulation folds 22 and 21 depart from each other to a position substantially co-planar to that of side edges 25 and 26, and 27 and 28 respectively, so as to eliminate the "V" shaped fold region otherwise formed in side panel means 17–18 and 19–20. Side panel means 17–18 and 19–20 respectively are thus substantially co-planar and parallel to each other, when container means 12 is in its fully erected deployed position.

Figure 3:
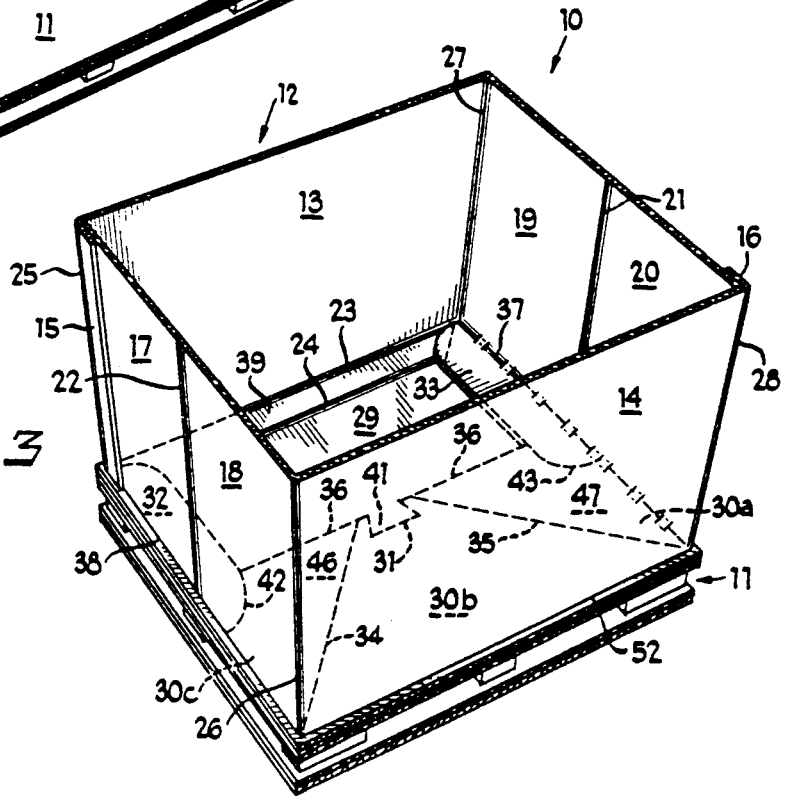
FIG. 3 is a perspective view of the fully articulated and deployed container, with the container means having its transition flap means, wing flap means and sealing flap means positioned and secured so as to seal the lower periphery of the container means upon introduction of articles and prevent the articles therewithin from migrating therethrough.

Transition flap means 30 hingedly emanates from the lower edge 52 of front panel means 14 so as to be able to move from its collapsed position adjacent and parallel to front panel means 14, to its deployed position adjacent to pallet means 11 and substantially perpendicular to front panel means 14. Transition flap means 30 is further joined to side panel means portions 18 and 20 respectively by wing flap means 46 and 47 respectively attached to transition flap side panels 30*c* and 30*a*. Wing flap means 46 and 47, hingedly emanate from side panel means portions 18 and 20 at lower edges 38 and 37, respectively overlie and are attached to a portion of the respective top surfaces of transition flap side panels 30*c* and 30*a*, as shown in FIG. 3. Transition flap side panels 30*c* and 30*a* are connected to transition flap center panel 30*b* by transition folds 35 and 34 respectively. Transition folds 34 and 35 allow transition flap means 30 with flap portions 30*a*, *b* and *c*, to become co-planar upon deployment of container means 12, while permitting transition flap side panels 30*a* and 30*c* to turn inwardly and overlie transition flap center panel 30*b* so as to be juxtaposed thereto when container means 12 is in its collapsed position. Bottom panel flap alignment means male tab member 41 is operably positioned on the front edge 36 of pallet attachment flap means 29 for aligned engagement within female slot 31 on the back edge of transition flap means 30, upon full deployment of apparatus 10 as shown in FIG. 3.

As further shown in FIG. 2, sealing flap means 32 and 33 hingedly emanate from respective side panel means 17–18 and 19–20 at lower edges 38 and 37. Sealing flap means 32 and 33 are positioned so a to extend from back panel means 13 towards front panel means 14, past articulation folds 22 and 21. In their collapsed position, sealing flap means 32 and 33 become automatically positioned juxtaposed to side panel means 17–18 and 19–20, respectively. Upon deployment, as front panel 14 is extended away from back panel 13, and as side panel means 17–18 are extended away from side panel means 19–20, sealing flap means 32 and 33 are automatically prompted from their storage position adjacent to side panel means 17–18 and 19–20, to positions juxtaposed to and on top of pallet attachment flap 29, so as to be substantially co-planar to wing flap means 46 and 47, and perpendicular to side panel means 17–18 and 19–20.

FIG. 3 demonstrates apparatus 10 in its fully articulated and deployed position. Front panel means 14, back panel means 13, side panel means, 17–18 and 19–20 and closure flap means 15 and 16 are all substantially vertical, perpendicular to pallet means 11, and interconnected so as to form an article-containing structure corresponding to container means 12. Back panel means 13 is positioned opposite front panel means 14, each of which are substantially perpendicular to side panel means 17–18 and 19–20, which are fully extended and opposite to each other. Side edges 25 and 26 and articulation fold 22 are all substantially coplanar with each other as well as with side panel means 17–18. Similarly side edges 27 and 28 and articulation fold 21 are all substantially co-planar with each other as well as with side panel means 19–20. The lower periphery of container means 12, as bounded by the lower edges 23, 52, 38 and 37 of the back panel means 13, front panel means 14 and side panel means 17–18 and 19–20 respectively, is, in the preferred embodiment, fully congruent with the outer periphery of pallet means 11.

Bottom panel means 29, 30 and 39 overlie pallet means 11 so as to substantially cove the entirety of the top surface of pallet means 11, as shown in FIG. 3. In the fully deployed position, pallet attachment flap 29, collapse flap 39 and transition flap means 30 are substantially co-planar to each other and parallel to pallet means 11. Furthermore pallet attachment flap 29 and transition flap means 30 are positioned so that the front edge 36 of pallet attachment flap 29 and the back edge 40 of transition flap means 30 are adjacent one another, with male tab member 41 of the bottom panel flap alignment means, operably engaging female slot 31 thereby assisting in restraining the relative positions of bottom panel means 29, 30 and 39 and, in turn, assisting in maintaining container means 12 from inadvertent or accidental collapse. The addition of articles into the container further maintains the bottom panel means 29, 30 and 39 and indeed the remainder of container means 12 in its deployed orientation.

Wing flap means 46 and 47, are hingedly attached to side panel means portions 18 and 20 respectively, as well as are attached to transition flap side panels means **30*c* and 30*a*, so as to be substantially parallel to and completely overlie transition flap side panels 30*c* and 30*a* upon full deployment of container means 12. Wing flap means 46 and 47 further contain recessed areas 42 and 43 for receipt of portions of sealing flap means 32 and 33, respectively, upon full deployment and articulation of container means 12. Upon receipt of sealing flap means 32 and 33, wing flap means 46 and 47 and sealing flap means 32 and 33 become substantially co-planar to each other, and collectively juxtaposed to portions of transition flap means 30 and pallet attachment flap 29 respectively. Sealing flap means 32 and 33, and wing flaps 46 and 47 are further positioned so that upon deployment of container means 12, the lower periphery of container means 12, is completely sealed so as to prevent materials held within container means 12 from migrating between lower edges 23, 52, 37 and 38; and pallet means 11**.

Figure 4:
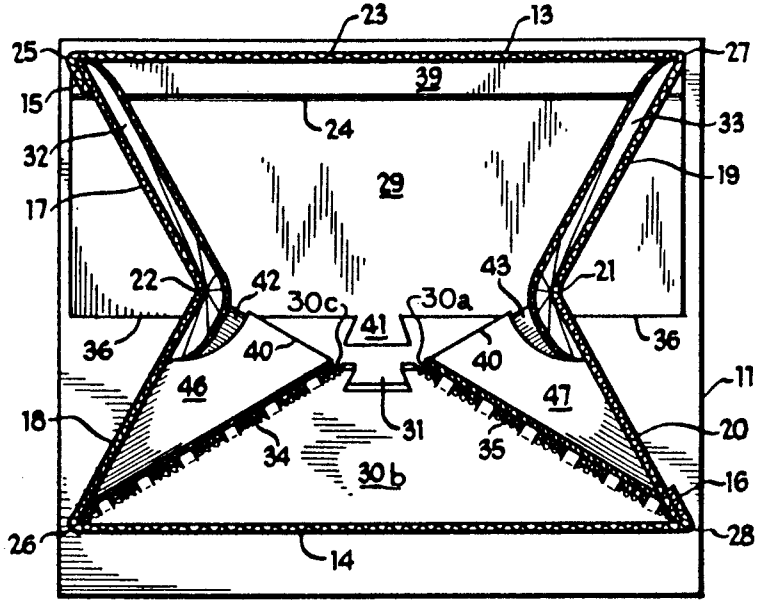
FIG. 4 is a top plan view of the collapsible pallet-container apparatus showing the container means in a preliminarily collapsed position whereby transition flap means, wing flap means, and sealing flap means are repositioned automatically from a position substantially parallel to side panel means and front panel means to a position substantially perpendicular to the side panel and front panel means.

As shown in FIG. 4, pallet means 11 is attached to container means 12 at pallet attachment flap 29 which contains male tab member 41 on front edge 36. Collapse flap 39 which is itself not attached to pallet means 11, is hingedly attached to back panel means 13 at lower edge 23. Collapse flap 39 is hingedly attached at its other side to pallet attachment flap 29 at double score fold 24. The distance between fold line 24 and back edge 23 comprises the height of collapse flap 39 when container means 12 and apparatus 10 are in the fully collapsed position; the same height of the overall profile of container means 12 when it has been minimized upon collapse.

Figure 5:
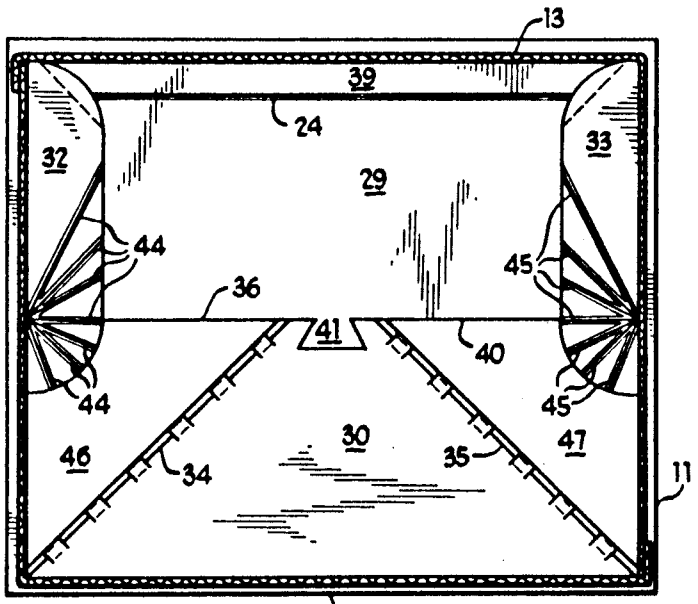
FIG. 5 is a top plan view of the fully deployed apparatus wherein the transition flap means and pallet attachment flap are adjacent so as to be substantially coplanar to each other and positioned with male tab member of bottom panel flap alignment means operably engaged within the female slot of the bottom panel flap alignment means.

Upon full deployment of the container apparatus, as shown sequentially in FIGS. 4 and 5, wing flap means 46 and 47 and transition flap means 30 move from their respective positions adjacent and juxtaposed to side panel means portions 18 and 20 and front panel means 14, to their deployed positions. Upon deployment, wing flaps 46 and 47 abut the now horizontal transition flap means 30 which has assumed a position co-planar with pallet attachment flap 29, juxtaposed to pallet means 11. Collapse prompting means embodied by crushed and scored hinges 34, 35 and 52, facilitate the transition of container means 12 from a deployed position to preliminary and fully collapsed positions and vice-versa. Similarly sealing flap means 32 and 33 move from their positions adjacent side panel means 17–18 and 19–20 to positions substantially co-planar to wing flap means 46 and 47, respectively. Wing flap means 46 and 47 receive sealing flap means 32 and 33 in recessed areas 42 and 43 so as to effectively seal the lower periphery of container means 12 against article migration. The starburst scoring pattern 44 and 45 of sealing flap means 32 and 33 imparts flexibility to sealing flap means 32 and 3 to enable automatic deployment from their respective positions adjacent side panel means 17–18 and 19–20 to rotate 90 degrees about folds 38 and 37, (FIGS. 9 and 10) and adjacent articulation folds 22 and 21, respectively adjacent thereto, as well as to facilitate similar repositioning upon collapse of container means 12.

Bottom panel means 29, 30 and 39, as shown in FIG. 5, cover substantially the entirety of the surface area bounded by pallet means 11, with the bottom panel means at least partially maintained in position by the cooperation of male tab member 41 of the bottom panel flap alignment means, operably engaging female slot 31 of bottom panel flap alignment means. Collapse flap 39, sealing flap means 32 and 33, wing flap means 46 and 47 and transition flap means 30 are all hingedly attached to back panel means 13, side panel means 17–18 and 19–20 and front panel means 14, respectively, at lower edges 23 (FIG. 9), 38, 37 and 52 (FIG. 3). By being hingedly attached to back panel means 13, side panel means 17–18 and 19–20, and front panel means 14, collapse flap 39, sealing flap means 32 and 33, wing flap means 46 and 47 and transition flap means 30 cooperate to effectively seal the lower periphery or the interior region of container means 12 to prevent migration of materials therewithin.

Figure 6:
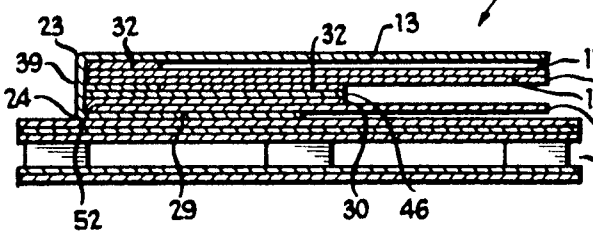
FIG. 6 is a cross-sectional view of the apparatus taken along lines 6—6 of FIG. 1 and looking in the direction of the arrows, showing the container means folded in upon itself in fully collapsed orientation so that the entirety of the container means is positioned between said back panel means and said pallet attachment flap juxtaposed to the pallet means.

Apparatus 10 is shown in the fully collapsed position for storage in FIG. 6. Pallet attachment flap 29 remains attached to pallet means 11 thereby keeping container means 12 attached to pallet means 11 at all times including during non-deployment. Container means 12 is permitted to fold in upon itself about collapse flap 39 to reduce and minimize the overall profile of apparatus 10 when not in use. The total height required by apparatus 10 while in the collapsed position is the height of pallet means 11 in combination with the height of collapse flap 39. Collapse flap 39 is hingedly attached to both back panel means 13 and pallet attachment flap 29 at lower edge 23 and double score fold 24 respectively. This configuration allows container means 12 to fold back towards and on top of pallet means 11 again minimizing the space required for storage of apparatus 10. Sandwiched between pallet attachment flap 29 and back panel means 13 is the remainder of container means 12.

Figure 7:
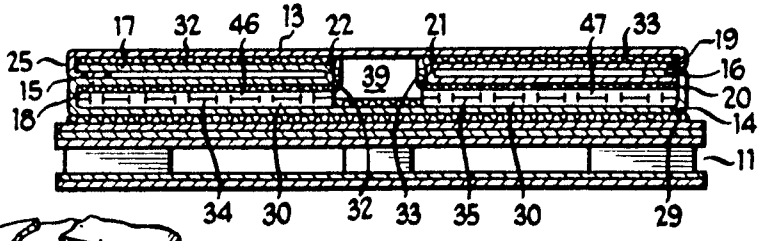
FIG. 7 is cross-sectional view of the apparatus taken along lines 7—7 of FIG. 2 and looking in the direction of the arrows, showing the container means in its fully collapsed position, folded back upon itself.

FIG. 7 shows another view of apparatus lo in its fully collapsed position. Pallet means 11 is attached to container means 12 at pallet attachment flap 29, with the remainder of container means 12 folded back over flap 29, about collapse flap 39.

Figure 8:
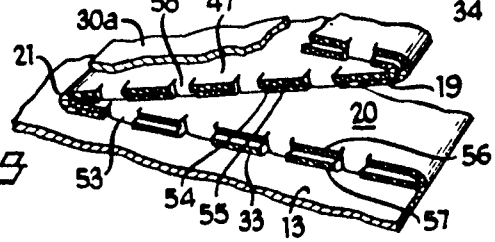
FIG. 8 is an enlarged perspective of the scored and crushed hinge folds operably positioned between the wing flap, sealing flap and side panel means respectively, which hinge folds include collapse prompting means.

Collapse prompting means, comprising alternating scored and crushed hinge folds along lower edge 37 of side panel means 19–20, are shown enlarged in FIG. 8. The folds are scored in such a way so as to permit one set of scoring 55 and 56 to be recessed, or offset, relative to their mated scores 54 and 57, when container means 12 is articulated to the collapsed position. Interposed between scores along lower edge 37 are non-scored, crushed regions 53 and 58. To obtain optimum efficiency of such alternating scoring and crushing, crushed regions such as 53 and 58 should not be positioned beneath perpendicular folds such as articulation folds 21 or 22. This particular construction of hinge fold prompts adjoining flaps and panels to both a 0 degree and 90 degree orientation, to create a bias therebetween, to prompt respective side panels, wing flaps, and bottom panel means into either a fully deployed or preliminarily collapsed orientation.

Container blank 12*a* is shown in FIG. 9 as including closure flap means 15 hingedly emanating from the side edge of back panel means 13 at closure flap fold 25; and collapse flap 39 hingedly emanating from back panel means 13 at lower edge 23 which is also attached to pallet attachment flap 29 at double scored fold 24. Also shown as embodied by this blank 12*a* portion are: pallet attachment flap 29 with male tab member 41; side panel means 19–20 hingedly attached to the side edge of back panel means 13 at side panel fold 27; articulation fold 21 equally positioned midway between side panel portions 19 and 20; sealing flap means 33 hingedly attached along lower edge 37 of side panel means 19–20; and wing flap means 47 with recessed area 43 for operable receipt of sealing flap means 33. As shown, sealing flap means 33 is further scored in a starburst pattern for flexible movement of the sealing flap relative to the side and bottom panels. Starburst scoring pattern 45 utilizes articulation fold 21 as a center for the starburst pattern.

FIG. 10 shows container means blank 12*b* for attachment to blank 12*a*, along closure flaps 15 and 16, toward integration into the overall container means 12. Blank 12*b* includes front panel means 14 hingedly attached to closure flap means 16, transition flap means 30*a–c* and side panel means 17–18. Blank 12*b* further includes transition flap means fold 52, side panel fold 26 and articulation fold 22. Transition flap means 30*a–c* includes fold lines 34 and 35 positioned at a substantially 45 degree angle to back edge 40 of transition flap means 30 which continue to the corners formed by front edge 52 and the respective side edges of transition flap means 30—to form transition flap side panels 30*a* and 30*c* and transition flap center panel 30*b*. Female slot 31 of bottom panel flap alignment means is further positioned on back edge 40 of transition flap means 30 so that, upon articulation and full deployment of container means 12, it operably engages and receives male tab member 41 of the bottom panel flap alignment means.

As further shown in FIG. 10, side panel means 17–18 includes articulation fold 22 positioned midway between side panel portions 17 and 18. Emanating from lower edge 38 of side panel means 17–18 is wing flap means 46 being hingedly attached thereto so as to facilitate the folding and articulation of wing flap means 46 upon positioning container means 12 into its fully deployed position. Wing flap means 46 additionally has recessed area 42 so as to receive sealing flap means 32. Sealing flap means 32 is additionally shown in FIG. 10 with starburst scoring pattern 44, utilizing the articulation fold 22 as the center for such scoring. In FIGS. 9 and 10, fold lines 34, 35, 37, 38 and 52 contain collapse prompting means comprising the above described alternating scored and crushed hinges; for prompting folds to the 0 and 90 degree positions.

It is further contemplated that the apparatus may include other features not shown in the drawings. One such feature can be a top cover to be positioned adjacent to, on top of and about the upper edges of the front, back and side panel means so as to completely enclose and secure the interior region of the container means and, in turn, the articles therein. Another such feature may include support members positioned vertically in the respective corners, or horizontally along the height of the container means so as to reinforce the container means when in the fully deployed configuration. A portion of the front, back and/or side panels may additionally be flap cut and folded inwardly to restrain such vertical or horizontal support members in place at the corners or along the height of a particular panel.

The foregoing description and drawings merely explain and illustrate the invention and the invention is not limited thereto except as the appended claims are so limited, as those skilled in the art who have the disclosure before them will be able to make modifications and variations therein without departing from the scope of the invention.

What is claimed is:

1. A collapsible pallet container apparatus for automatically prompting orientation of a palletized container, in a facilitated manner, between an articulated, deployed position, in which articles may be positioned therewithin an interior region of the container during containment, storage and transportation of said articles, and an articulated collapsed position for minimizing the overall profile of the palletized container when not in use, said apparatus comprising:

a pallet means for supporting and moving said container, said pallet means having a top surface on said container is positioned;

said container including a front panel having an upper edge, a lower edge opposite to said upper edge and two side edges positioned opposite to each other between said upper and lower edges respectively, a back panel having an upper edge, a lower edge opposite to said upper edge and two side edges positioned opposite to each other between said upper and lower edges respectively, one or more side panels operably interposed between said front and back panels, each of said one or more side panels having an upper edge, a lower edge opposite to said upper edge, and two side edges positioned opposite to each other between said upper and lower edges respectively;

at least one of said one or more said panels being articulated through panel articulation means, so as to fold inwardly towards said interior region upon reconfiguration of said apparatus from said deployed position to said collapsed position;

each of said side edges of said front panel, back panel and one or more side panels being operably and hingedly attached to one another respectively, in succession;

said container further comprising a bottom panel having a front edge, a back edge and one or more side edges;

said bottom panel covering at least a portion of said pallet means, with at least a portion of said bottom panel being restrainably attached to said top surface of said pallet means;

said bottom panel operably emanating from the respective lower edge of at least one of said front, back and side panels at a respective one of said front, back and side edges of said bottom panel, said bottom panel being hingedly attached thereto said respective lower edge by at least one bottom panel fold; and collapse prompting means operably positioned in at least one of said front, back, side and bottom panels for co-operation with said panel articulation means towards prompting the facilitated collapse of said container from said deployed position towards and into said collapsed position, upon initiation of reorientation of at least one of said fronts, back, side and bottom panels, while said apparatus is in a said articulated deployed position.

2. The collapsible pallet container apparatus according to claim 1 in which:

said container further comprises one or more automatically deployable and collapsible sealing flap means for further maintaining said articles within said container, said sealing flap means emanating from said lower edge of said at least one of said one or more side panels, each of said one or more sealing flap means being hingedly attached to each respective side panel by at least one seal flap fold;

each of said one or more sealing flap means being capable of automatically articulating from a position juxtaposed to said respective one or more side panels to a position juxtaposed to said bottom panel upon articulation of said container to said deployed position from said collapsed position, so as to seal gaps between said one or more side panels and said bottom panel to, in turn, preclude inadvertent migration of said articles therethrough;

each of said one or more sealing flap means being capable of automatically articulating from a position juxtaposed to said bottom panel to said position juxtaposed to said respective one or more side panels upon articulation of is container from said deployed position to said collapsed position so as to enable full collapse of the apparatus towards minimizing the overall profile of said when not in use.

3. The collapsible pallet container apparatus according to claim 2 wherein at least one of said one or more side panels further includes:

one or more wing flap members hingedly emanating from a portion of said lower edge of said respective one or more side panels by at least one wind flap fold;

each of said one or more wind flap members being capable of automatically articulating from a position substantially juxtaposed to said respective side panel from which it emanates to a substantially horizontal position adjacent said bottom panel and substantially perpendicular to said respective side panel, upon articulation of said container to said deployed position, so as to seal gaps between said respective side panel and said bottom panel to, in turn, preclude inadvertent migration of said articles therethrough;

each of said one or more wing flap members being capable of automatically articulating from said substantially horizontal position adjacent said bottom panel to said position substantially juxtaposed to said respective side panel upon articulation of said container from said deployed position to said collapsed position so as to engage full collapse towards said minimized profile of said apparatus;

each of said one or more wing flap members further being restrainably attached to at least a portion of said bottom panel so as to further effectively seal gaps between said respective said panel and said bottom panel to, in turn, preclude inadvertent migration of said articles therethrough upon full articulation of said container to said deployed position.

4. The collapsible pallet container apparatus according to claim 1 in which said bottom panel includes a collapse flap, a pallet attachment flap, transition flap and bottom panel flap alignment means for aligning the positions of said pallet attachment flap and said transition flap on said top surface of said pallet means wherein said collapse flap, said pallet attachment flap and said transition flap operably cooperate with each other and with said front, back and side panels to promote said facilitated transition of said apparatus between said respective deployed and collapsed configurations, together with minimizing the overall profile of said apparatus in said collapsed configuration.

5. The collapsible pallet container apparatus according to claim 4 wherein said bottom panel flap alignment means comprises a male tab member emanating from one of said pallet attachment flap and said transition flap and a female slot in the other of said pallet attachment flap and said transition flap for secured receipt of said male tab member, to effectively align and lock the pallet attachment flap relative to the transition flap when said container is articulated to said 6. The collapsible pallet container apparatus according to claim 8 wherein said bottom panel flap alignment means creates an interlocking fit between said male tab member and said female slot.

7. The collapsible pallet container apparatus according to claim 4 in which said collapse flap, said pallet attachment flap, and said transition flap are constructed to effectively seal at least a portion of said respective lower edges of said front and back panels so as to prevent migration of materials from said interior region;

said collapse flap hingedly positioned between said lower edge of said back panel and said pallet attachment flap;

said collapse flap having a height substantially corresponding to the height of said container in its fully collapsed orientation, to enable repositioning of said collapsed container in an orientation juxtaposed o and over said pallet means.

8. The collapsible pallet container apparatus according to claim 4 in which said pallet attachment flap includes a front edge, a back edge opposite thereto and two side edges respectively interposed therebetween, said pallet attachment flap hingedly emanating from said collapse flap at said back edge of said pallet attachment flap by an attachment flap fold, said pallet attachment flap being secured by pallet attachment means to said pallet means;

said front edge of said pallet attachment flap being positioned to extend between said respective panel articulation means in said one or more side panels upon articulation of said container to said deployed position.

9. The collapsible pallet container apparatus according to claim 4 in which said transition flap includes a front edge, a back edge opposite thereto and tow said edges respectively interposed therebetween, said transition flap operably and hingedly emanating from said lower edge of said front panel at said front edge of said transition flap by a transition flap fold, said back edge of said transition flap being positioned to extend between said respective panel articulation means in said one or more side panels upon articulation of said container to said deployed position;

said transition flap comprising a transition flap center panel and two transition flap side panels each of which is attached on opposite sides of said transition flap center panel by transition panel folds for articulation therebetween;

said apparatus further including two ring flap members, at least one of which hingedly emanates from a portion of said lower edge of a respective one of said one or more side panels by a wing flap fold;

each of said two wing flap members being capable of automatically articulating from a position substantially juxtaposed to said respective side panels from which it emanates to a position parallel to said pallet means and substantially perpendicular to said respective side panel, upon articulation of said container to said deployed position;

each of said two wing flap members further being operably and restrainably attached to a respective one of said two transition flap side panels in said transition flap so as to further effectively seal gaps between said respective side panel and said transition flap to, in turn, preclude inadvertent migration of said articles therethrough upon full articulation of said container from said collapsed position to said deployed position;

each of said wing flap members being capable of automatically articulating from said position parallel to said pallet attachment flap to a position substantially juxtaposed to said respective side panel upon articulation of said container from said deployed position to said collapsed position so as to facilitate full collapse of said container towards said minimized apparatus profile.

10. The collapsible pallet container apparatus according to claim 1 wherein said container is formed out of a substantially biodegradable material.

11. The collapsible pallet container apparatus according to claim 1 wherein said container is formed out of a paper-board material.

12. The collapsible pallet container apparatus according to claim 1 wherein said container is formed out of a corrugated paperboard material.

13. The collapsible pallet container apparatus according to claim 1 wherein said pallet means is formed from a corrugated paperboard material.

14. A collapsible pallet container apparatus for automatically prompting orientation of a palletized container, in a facilitated manner, between an articulated deployed position, in which articles may be positioned therewithin an interior region of the container during containment, storage and transposition of said articles, and an articulated collapsed position for minimizing the overall profile of the palletized container when not in use, said apparatus comprising:

pallet means for supporting and moving said container, said pallet means having a top surface on which said container is positioned;

said container including a front panel having an upper edge, a lower edge opposite to said upper edge and two side edges positioned opposite to each other between said upper and lower edges respectively, a back panel having an upper edge, a lower edge opposite to said upper edge and two side edges positioned opposite to each other between said upper and lower edges respectively, one or more side panels operably interposed between said front and back panels, each of said one or more side panels having an upper edge, a lower edge opposite to said upper edge, and two side edges positioned opposite to each other between said upper and lower edges respectively;

at least one of said one or more side panels being articulated through panel articulation means, so as to fold inwardly towards said interior region upon reconfiguration of said apparatus from said deployed position to said collapsed position;

each of said side edges of said front panel, back panel and one or more side panels being operably and hingedly attached to one another respectively, in succession;

said container further comprising a bottom panel having a front edge, a back edge and one or more side edges;

said bottom panel covering at least a portion of said pallet means, with at least a portion of said bottom panel being restrainably attached to said top surface of said pallet means;

said bottom panel operably emanating from the respective lower edge of at least one of said front, back and side panels at a respective one of said front, back and side edges of said bottom panel, said bottom panel being hingedly attached thereto said respective lower edge by at least one bottom panel fold;

collapse prompting means associated with at least one of said bottom panel and said panel articulation means for prompting the facilitate collapse of said container from said deployed position towards said collapsed position, upon reorientation of at least one of said front, back and side panels while said apparatus is in said articulated deployed position;

said container further comprising one or more automatically deployable and collapsible sealing flap means for further maintaining said articles within said container, said sealing flap means emanating from said lower edge of said at least one of said one or more side panels, each of said one or more sealing flap means being hingedly attached to each respective side panel by at least one seal flap fold;

each of said one or more sealing flap means being capable of automatically articulating from a position juxtaposed to said respective one or more side panels to a position juxtaposed to said respective one or more side panels to a position juxtaposed to said bottom panel upon articulation of said container to said deployed position from said collapsed position, so as to seal gaps between said one or more side panels and said bottom panel to, in turn, preclude inadvertent migration of said articles therethrough;

each of said one or more sealing flap means being capable of automatically articulating from said position juxtaposed to said bottom panel to said position juxtaposed to said respective one or more side panels upon articulation of said container from said deployed position to said collapsed position so as to enable full collapse of the apparatus towards minimizing the overall profile of same when not in use;

one or more wing flap members hingedly emanating from a portion of said lower edge of said respective one or more side panels by at least one wing flap fold;

each of said one or more wing flap members being capable of automatically articulating from a position substantially juxtaposed to said respective side panel from which it emanates to a substantially horizontal position adjacent said bottom panel and substantially perpendicular to said respective side panel, upon articulation of said container to said deployed position, so as to seal gaps between said respective side panel and said bottom panel to, in turn, preclude inadvertent migration of said articles therethrough;

each of said one or more wing flap members being capable of automatically articulating from said substantially horizontal position adjacent said bottom panel to said position substantially juxtaposed to said respective side panel upon articulation of said container from said deployed position to said collapsed position so as to enable full collapse towards said minimized profile of said apparatus; and each of said one or more wing flap members further being restrainably attached to at least a portion of said bottom panel so as to further effectively seal gaps between said respective side panel and said bottom panel to, in turn, preclude inadvertent migration of said articles therethrough upon full articulation of said container to said deployed position.

15. The collapsible pallet container apparatus according to claim 14 in which:

said back panel is operably positioned opposite to said front panel;

said one or more side panels comprises two side panels each operably positioned opposite the other so as to be respectively positioned between said front and back panels;

said panel articulation means being operably positioned in each of said two side panels with each said panel articulation means comprising an articulation fold extending substantially from said respective upper edge to said respective lower edge of each said side panel, and positioned substantially midway between the respective side edges of each of said two side panels so as to divide each of said two side panels substantially in half;

said collapse prompting means being capable, during collapse of said container of retracting each said articulation fold inwardly towards said interior region, and, in turn, towards simultaneously drawing said front and back panels inwardly towards each other to reduce the overall collapsed profile of said container.

16. The collapsible pallet container apparatus according to claim 15 in which:

said one or more automatically deployable and collapsible sealing flap means comprises two sealing flaps, each of which is positioned so as to emanate from a respective one of id two side panels and extending substantially to the lower edge of said back panel, each of said sealing flaps being positioned substantially opposite each other and extending towards said front panel beyond the location of said articulation fold in each of said two side panels;

each of said two sealing flaps being scored with a starburst score pattern proximate to the location of said articulation fold in each said two side panels to facilitate the automatic deployment and collapse of said sealing flaps.

17. The collapsible pallet container apparatus according to claim 16 in which each of said side panels includes one said one or more wing flap member:

each of said wing flap members further including a recessed region for receipt of at least a portion of said respective sealing flap upon articulation of said container to both said deployed and collapsed position;

said sealing flaps and said wing flap members being substantially coplanar to each other and substantially perpendicular to said respective front, back and side panels, upon articulation of said container to said deployed position with said wing flap members and said sealing flaps being juxtaposed to said bottom panel.

18. The collapsible pallet container apparatus according to claim 15 in which said container further comprises one or more closure flaps emanating from and hingedly attached to one of the side edges of at least on of said front and back panels by a closure flap fold;

said one or more closure flaps comprising two closure flaps, each of which includes an upper edge, a lower edge and two side edges positioned opposite to each other between said upper and lower edges of each respectively;

one said side edge of a first of said two closure flaps hingedly emanating from one of said side edges of said front panel at said closure flap fold and one said side edge of a second of said two closure flaps hingedly emanating from one of the side edges of said back panel at said closure flap fold;

each of said closure flaps being restrainably attachable to a respective adjacent one of said two side panels to integrate said front panel, back panel, said panels and bottom panel into a single integrated container.

19. The collapsible pallet container apparatus according to claim 18 in which said container is formed out of a first and second blank:

said first blank including said back panel, at least a first portion of said bottom panel, a first of said two side panels, a first of said two closure flaps, a first of said two wing flap members and a first of said two sealing flaps;

said second blank including said front panel, at least a second portion of said bottom panel, a second of said two side panels, a second of said two closure flaps, a second of said two wing flap members and a second of said two sealing flaps.

20. A collapsible pallet container apparatus for automatically prompting orientation of a palletized container, in a facilitated manner, between an articulated, deployed position, in which articles may e positioned therewithin an interior region of the container during containment, storage and transportation of said articles, and an articulated collapsed position for minimizing the overall profile of the palletized container when not in use, said apparatus comprising:

pallet means or supporting and moving said container, said pallet means having a top surface on which said container is positioned;

said container including a front panel having an upper edge, a lower edge opposite to said upper edge and two side edges positioned opposite to each other between said upper and lower edges respectively, a back panel having an upper edge, a lower edge opposite to said upper edge and two side edges positioned opposite to each other between said upper and lower edges respectively, one or more side panels operably interposed between said front an back panes, each of said one or more side panels having an upper edge, a lower edge opposite to said upper edge, and two side edges positioned opposite to each other between said upper had lower edges respectively;

at least one of said one or more side panels being articulated through panel articulation means, so as to fold inwardly towards said interior region upon reconfiguration of said apparatus from said deployed position to said collapsed position;

each of said side edges of said front panel, back panel and one or more side panels being operably and hingedly attached to one another respectively, in succession;

said container further comprising a bottom panel having a front edge, a back edge and one or more side edges;

said bottom panel covering at least a portion of said pallet means, with at least a portion of said bottom panel being restrainably attached to said top surface of said pallet means;

said bottom panel operably emanating from the respective lower edge of at least one of said front, back nd side panels at a respective one of said front, back and side edges of said bottom panel, said bottom panel being hingedly attached thereto said respective lower edge by at least one bottom panel fold;

collapse prompting means associated with at least one of said bottom panel and said panel articulation means for prompting the facilitated collapse of said container from said deployed position towards said collapsed position, upon reorientation of at least one of said front, back and side panels while said apparatus is in said articulated deployed position;

said bottom panel including a collapse flap, a pallet attachment flap, transition flap and bottom panel flap alignment means for aligning the positions of said pallet attachment flap and said transition flap on said top surface of said pallet means wherein said collapse flap, pallet attachment flap and transition flap operably cooperate with each other and with said front, back and side panels to promote said facilitated transition of said apparatus between said respective deployed and collapsed configurations, together with minimizing the overall profile of said apparatus in sad collapsed configuration;

said transition flap including a font edge, a back edge opposite thereto and two side edges respectively interposed therebetween, said transition flap operably and hingedly emanating from said lower edge of said front panel at said front edge of said transition flap by a transition flap fold, said back edge of said transition flap being positioned to extend between said respective panel articulation means in said one or more side panels upon articulation of said container to said deployed position;

said transition flap comprising a transition flap center panel and two transition flap side panels each of which is attached on opposite sides of said transition flap center panel by transition panel folds for articulation therebetween;

said apparatus further including two wing flap members, at least one of which hingedly emanates from a portion of said lower edge of a respective one of said one or more side panels by a wing flap fold;

each of said two wing flap members being capable of automatically articulating from a position substantially juxtaposed to said respective side panels from which it emanates to a position parallel to said pallet means and substantially perpendicular to said respective side panel, upon articulation of said container to said deployed position;

each of said two wing flap members further being operably and restrainably attached to a respective one of said two transition flap side panels in said transition flap so as to further effectively seal gaps between said respective side panel and said transition flap to, in turn, preclude inadvertent migration of said articles therethrough upon full articulation of said container from said collapsed position to said deployed position;

each of said wing flap members being capable of automatically articulating from said position parallel to said pallet attachment flap to a position substantially juxtaposed to said respective side panel upon articulation of said container from said deployed position to said collapsed position so as to facilitate full collapse of said container towards said minimized apparatus profile.

21. The automatically deployable and collapsible pallet container apparatus according to claim 20 in which said collapse prompting means comprises said wing flap fold, said transition flap fold and said transition panel folds each having alternating scored and crushed hinge folds;

said alternating scored and crushed hinge folds operably biasing respective aligned ones of said wing flap members, said front panel, side panels, transition flap center panel and transition flap side panels to 0 to 90 degree orientations relative to one another respectively, to in turn, create a bias in said container and to, in turn, prompt said respective side panels, wing flap members, front panel and transition flap into a fully deployed configuration, and, upon said reorientation of at least one of said front, back and side panels, into a preliminarily collapsed position towards further apparatus collapse.

* * * * *

UNITED STATES PATENT AND TRADEMARK OFFICE

CERTIFICATE OF CORRECTION

PATENT NO. : 5,301,872

DATED : April 12, 1994

INVENTOR(S) : Michael A. Tusing, Robert B. Leftwich

It is certified that error appears in the above-indentified patent and that said Letters Patent is hereby corrected as shown below:

| | |
|---|---|
| Col. 2, Line 15 | After "container" delete "," and insert — . —. |
| Col. 9, Line 19 | After "substantially" delete "cove" and insert — cover —. |
| Col. 10, Line 24 | After "3" insert — 3 —. |
| Col. 11, Line 1 | After "apparatus" delete "lo" and insert — 10 —. |
| Col. 12, Line 43 | Delete "a". |
| Col. 12, Line 44 | After "on" insert — which —. |
| Col. 12, Line 60 | After "more" delete "said" and insert — side —. |
| Col. 13, Line 22 | After "panels" delete ",". |
| Col. 13, Line 47 | After "of" delete "is" and insert — said —. |
| Col. 13, Line 50 | After "of" delete "said" and insert — same —. |

UNITED STATES PATENT AND TRADEMARK OFFICE

CERTIFICATE OF CORRECTION

PATENT NO. : 5,301,872

DATED : April 12, 1994

INVENTOR(S) : Michael A. Tusing, Robert B. Leftwich

It is certified that error appears in the above-indentified patent and that said Letters Patent is hereby corrected as shown below:

| | |
|---|---|
| Col. 13, Line 56 | After "one" delete "wind" and insert — wing —. |
| Col. 13, Line 58 | After "more" delete "wind" and insert — wing —. |
| Col. 14, Line 7 | After "to" delete "engage" and insert — enable —. |
| Col. 14, Line 12 | After "respective" delete "said" and insert — side —. |
| Col. 14, Line 38 | After "said" insert — deployed position —. |
| Col. 14, Line 40 | After "claim" delete "8" and insert — 5 —. |
| Col. 14, Line 56 | After "juxtaposed" delete "o" and insert — to —. |
| Col. 15, Line 5 | After "and" delete "tow" and insert — two —. |

UNITED STATES PATENT AND TRADEMARK OFFICE

CERTIFICATE OF CORRECTION

PATENT NO. : 5,301,872

DATED : April 12, 1994

INVENTOR(S) : Michael A. Tusing, Robert B. Leftwich

It is certified that error appears in the above-indentified patent and that said Letters Patent is hereby corrected as shown below:

| | |
|---|---|
| Col. 16, Line 59 | After "to" delete "a position juxtaposed to said respective one or more side panels to". |
| Col. 17, Line 68 | After "of" delete "id" and insert — said —. |
| Col. 18, Line 31 | After "of" delete "on" and insert — one —. |
| Col. 18, Line 46 | After "panel" delete "said" and insert — side —. |
| Col. 18, Line 65 | After "may" delete "e" and insert — be —. |
| Col. 19, Line 15 | Before "back" delete "an" and insert — and —. |
| Col. 19, Line 15 | After "back" delete "panes" and insert — panels —. |
| Col. 19, Line 18 | After "upper" delete "had" and insert — and —. |

UNITED STATES PATENT AND TRADEMARK OFFICE

CERTIFICATE OF CORRECTION

PATENT NO. : 5,301,872

DATED : April 12, 1994

INVENTOR(S) : Michael A. Tusing, Robert B. Leftwich

It is certified that error appears in the above-indentified patent and that said Letters Patent is hereby corrected as shown below:

| | |
|---|---|
| Col. 19, Line 38 | After "back" delete "nd" and insert -- and --. |
| Col. 19, Line 61 | After "in" delete "sad" and insert -- said --. |
| Col. 20, Line 4 | After "fold" delete "," and insert -- ; --. |

Signed and Sealed this

Twenty-first Day of March, 1995

*Attest:*

Bruce Lehman

BRUCE LEHMAN

*Attesting Officer*

*Commissioner of Patents and Trademarks*